US006874180B2

(12) United States Patent
Liao

(10) Patent No.: US 6,874,180 B2
(45) Date of Patent: Apr. 5, 2005

(54) RUG BED CLOTH STRUCTURE FOR ASSISTING IN HOLDING A USER'S LEGS IN A FIXED POSITION

(76) Inventor: Ming-Zhen Liao, No. 505, Guangfu Rd., Huwei Jen, Yunlin (TW)

( * ) Notice: Subject to any disclaimer, the term of this patent is extended or adjusted under 35 U.S.C. 154(b) by 0 days.

(21) Appl. No.: 10/321,394

(22) Filed: Dec. 18, 2002

(65) Prior Publication Data

US 2004/0117909 A1 Jun. 24, 2004

(51) Int. Cl.[7] ..... A47G 9/02

(52) U.S. Cl. ..... 5/486; 5/482; 5/662; 5/929; 5/925

(58) Field of Search ..... 5/482, 81.1 T, 5/929, 925, 662, 486, 485, 649

(56) References Cited

U.S. PATENT DOCUMENTS 1,201,157 A * 10/1916 Dawes ..... 5/485
3,843,980 A * 10/1974 Rodriguez ..... 5/733
4,122,567 A * 10/1978 Hanson ..... 5/722
4,383,343 A * 5/1983 Kulka ..... 5/648
4,528,706 A * 7/1985 Branker ..... 5/722
4,611,804 A * 9/1986 Addair ..... 482/131
5,121,516 A * 6/1992 Jones ..... 5/658
5,357,280 A * 10/1994 Yajima et al. ..... 348/349
5,791,000 A * 8/1998 Noyes ..... 5/657
6,148,458 A * 11/2000 Hires ..... 5/485
6,732,389 B2 * 5/2004 Drexler ..... 5/486

* cited by examiner

*Primary Examiner*—Michael Trettel
(74) *Attorney, Agent, or Firm*—Rosenberg, Klein & Lee

(57) ABSTRACT

A rug bed cloth structure is provided to assist in fixing a user's legs in a position. One end of the rug bed cloth is formed with a lattice net structure. The opposing end of the rug bed cloth is adapted to be secured to a spring bed. Using the lattice net to increase frictional resistance, it will provide action and reaction points for the user's legs, toes or fore part of the user's feet and prevent slipping. Another embodiment has a plurality of soft strips of material affixed on the upper side of the rug bed cloth. The strips of material form rings to support the user's feet.

1 Claim, 7 Drawing Sheets

RUG BED CLOTH STRUCTURE FOR ASSISTING IN HOLDING A USER'S LEGS IN A FIXED POSITION

BACK GROUND OF THE INVENTION

1. Field of the Invention

The invention provides a rug bed cloth which can assist holding a user's legs in a fixed position, The rug bed cloth can be spread on a bed to prevent a user from slipping as a result of the resistance provided by the rug bed cloth, and by the action and reaction provided by the toes or the fore part of the user's feet, the quality of a couple's sexuality is promoted and thereby increases the emotional bond between a wife and her husband.

2. Description of the Prior Art

Besides the great mission of propagation of the next generation, sexual intercourse between a wife and her husband can promote feelings toward each other and their enjoyment making love.

Most intercourse takes place on a bed. General spring beds only have a bedspread or summer sleeping mat spread thereon. When sexual intercourse takes place, the person whose knees are against the bedspread or summer sleeping mat will very easily slip, and that person's two legs or toes will not have action and reaction points. That circumstance will affect the quality of the couples sexual intercourse.

SUMMARY OF THE INVENTION

The principal purpose of this invention is to provide a kind of rug bed cloth structure which can assist holding a user's legs in a fix position. Using a lattice net can increase frictional resistance, avoiding the user's knees from slipping when a couple engages in sexual intercourse, and provides action and reaction points in an arbitrary direction for a user's two legs, toes or fore part of the user's feet. It can increase the quality of sexual intercourse of the couple and promotes feelings between the wife and her husband.

Another purpose of this invention is to provide a kind of rug bed cloth structure which can assist holding a user's legs in a fixed position using point-like intermittent sewing for fixing soft strips of material to form closed ring structure on the upper side of the rug bed cloth. When engaging in sexual intercourse, the strip material and ring will produce support for a user's feet, providing action and reaction points for the user's two legs, toes or fore part of the user's feet. So, it can promote the quality of sexual intercourse of a couple and increase their feelings toward each other.

The other purpose of this invention is to provide a kind of rug bed cloth structure which can assist holding a user's legs in a fixed position.

BRIEF DESCRIPTION OF THE DRAWINGS

The drawings disclose an illustrative embodiment of the present invention which serves to exemplify the various advantages and objects hereof, and are as follows.

DETAILED DESCPIPTION OF THE PREFERED EMBODIMENT

Figure 1:
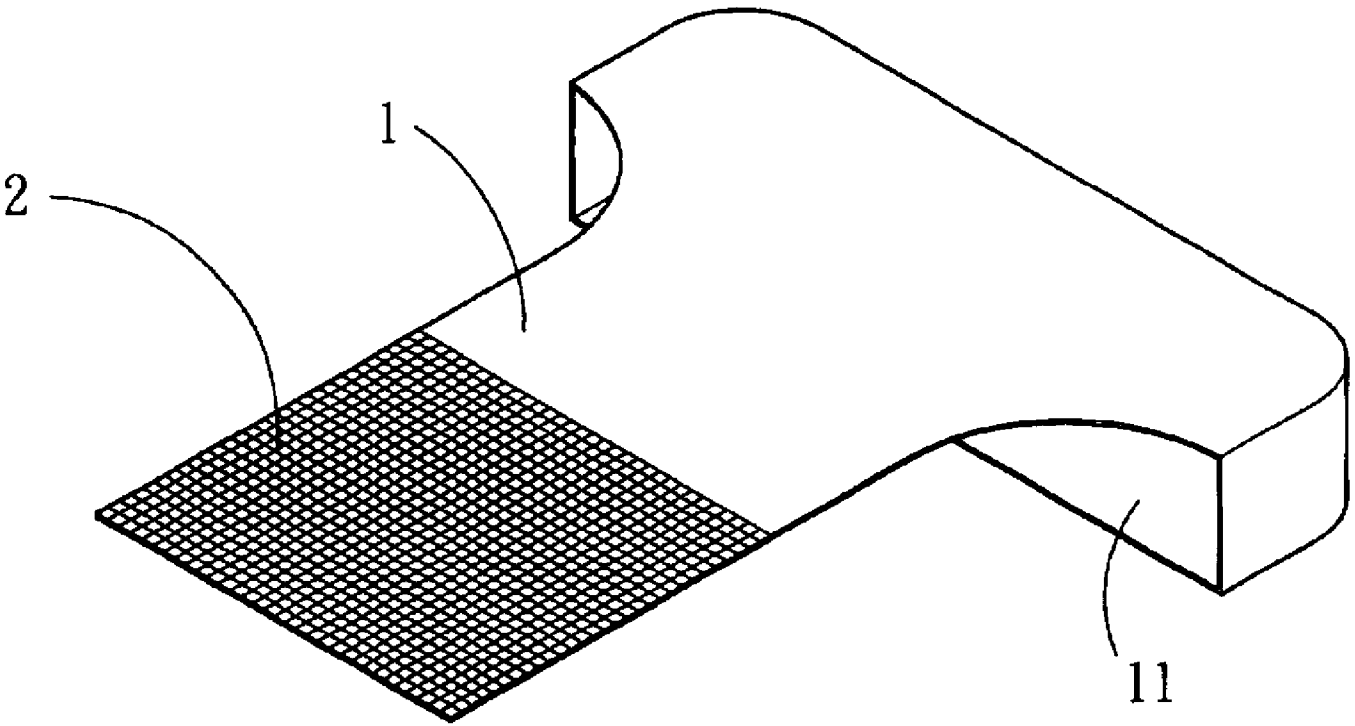
FIG. 1 shows a perspective view of the first embodiment.
Figure 2:
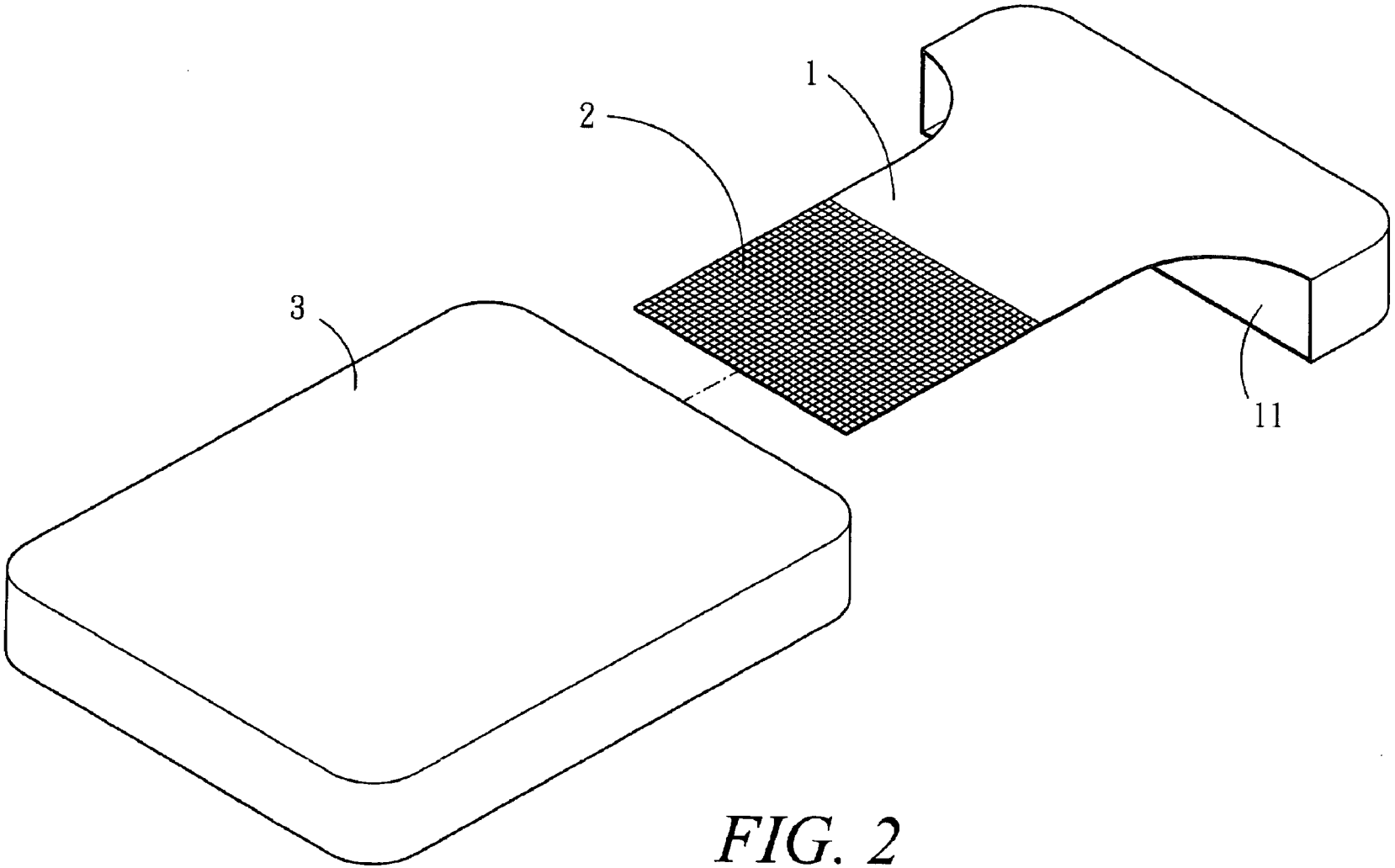
FIG. 2 shows the first embodiment combined with a spring bed.
Figure 3:
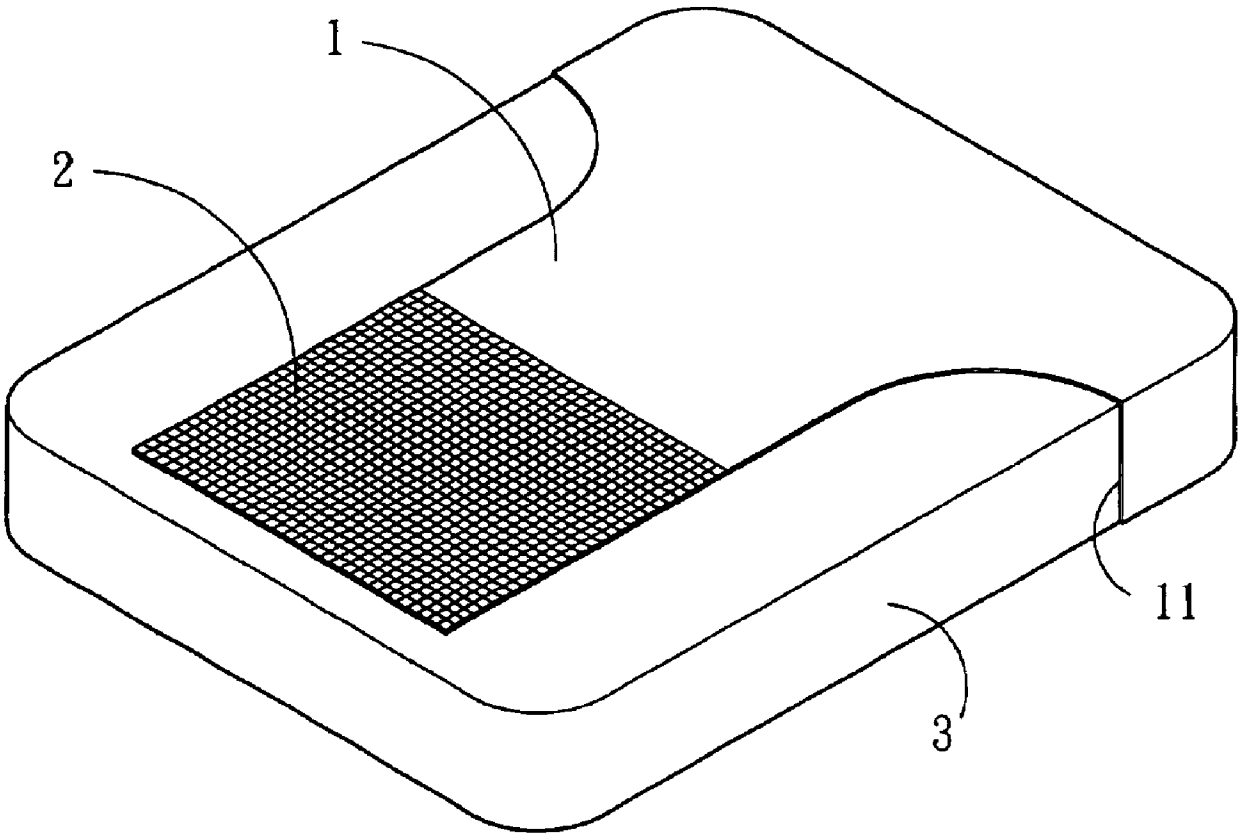
FIG. 3 shows the combination of the first embodiment spread on a spring bed.

Please refer FIG. 1 to FIG. 3 which show the first embodiment of this invention, a combination of rug bed cloth 1 and lattice net 2. Rug bed cloth is a blanket product, its fixed end has a shape like a loudspeaker that defines an open pocket 11. The open pockey receives an end of the spring bed 3, as general bedspread does (FIG. 3). The net structure of lattice net 2 is made by cloth or other material. The lattice net 2 is used to increase frictional resistance, preventing slipping of the user's knees and provide action and reaction points for the user's two legs, toes or fore part of the user's feet. The free end of rug bed cloth 1 and lattice net 2 are combined into one structure by sewing, adhering or another equivalent fixing method, and is used to spread on the spring bed 3.

Figure 4:
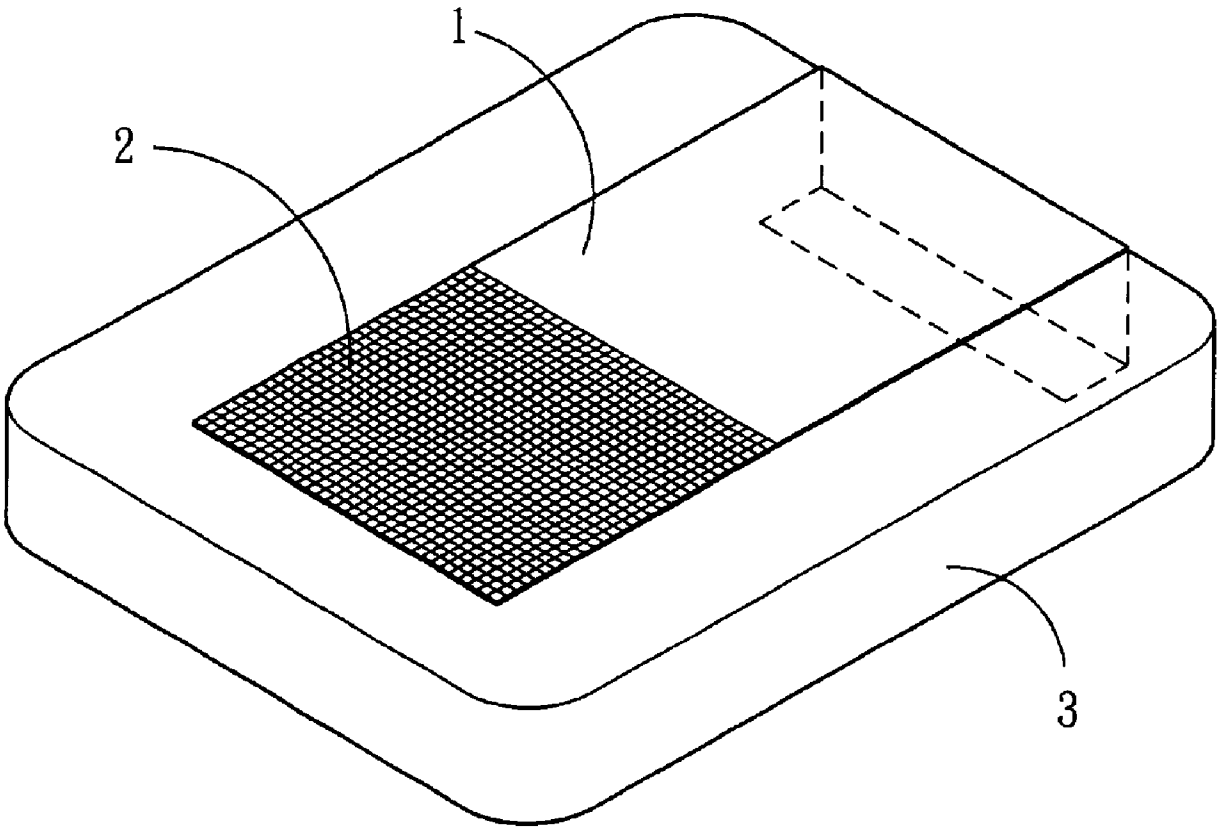
FIG. 4 shows another configuration of the first embodiment spreads on a spring bed.

Please refer to FIG. 4, the fixed end of the rug bed cloth 1 is not shaped like a loudspeaker, but is an extended part of the plane of the rug bed cloth 1, the extended part being tucked under the spring bed 3 for fixing the rug bed cloth 1.

Figure 5:
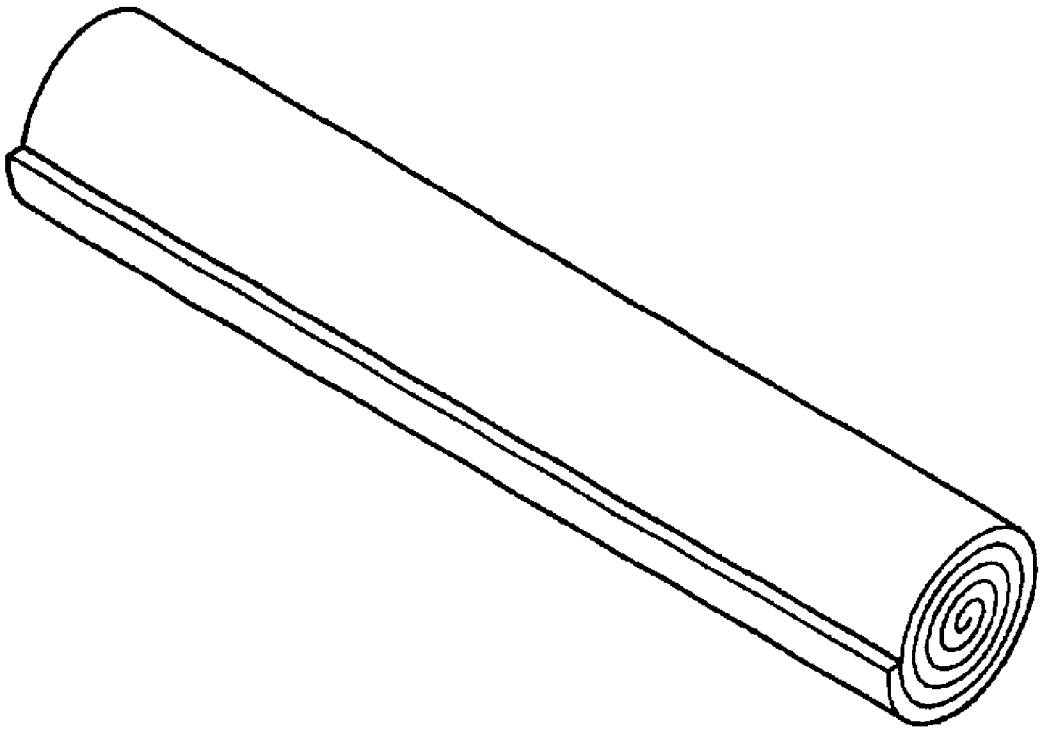
FIG. 5 shows a perspective view of the first embodiment in a rolled condition.

Because both of rug bed cloth 1 and lattice net 2 are soft materials, the rug bed cloth can be rolled for travel or storage, as shown inn FIG. 5.

Figure 6:
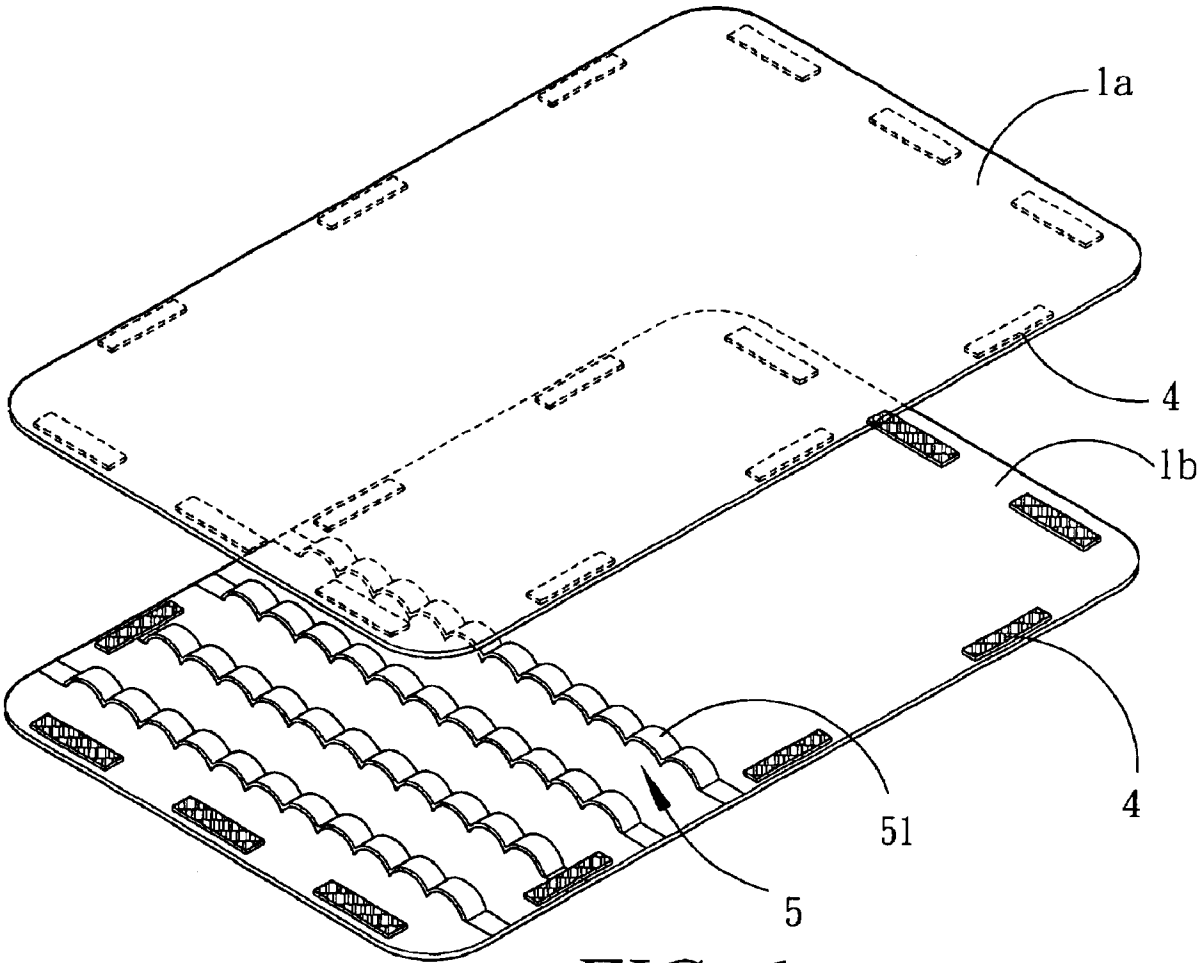
FIG. 6 shows a perspective view of the second embodiment.
Figure 7:
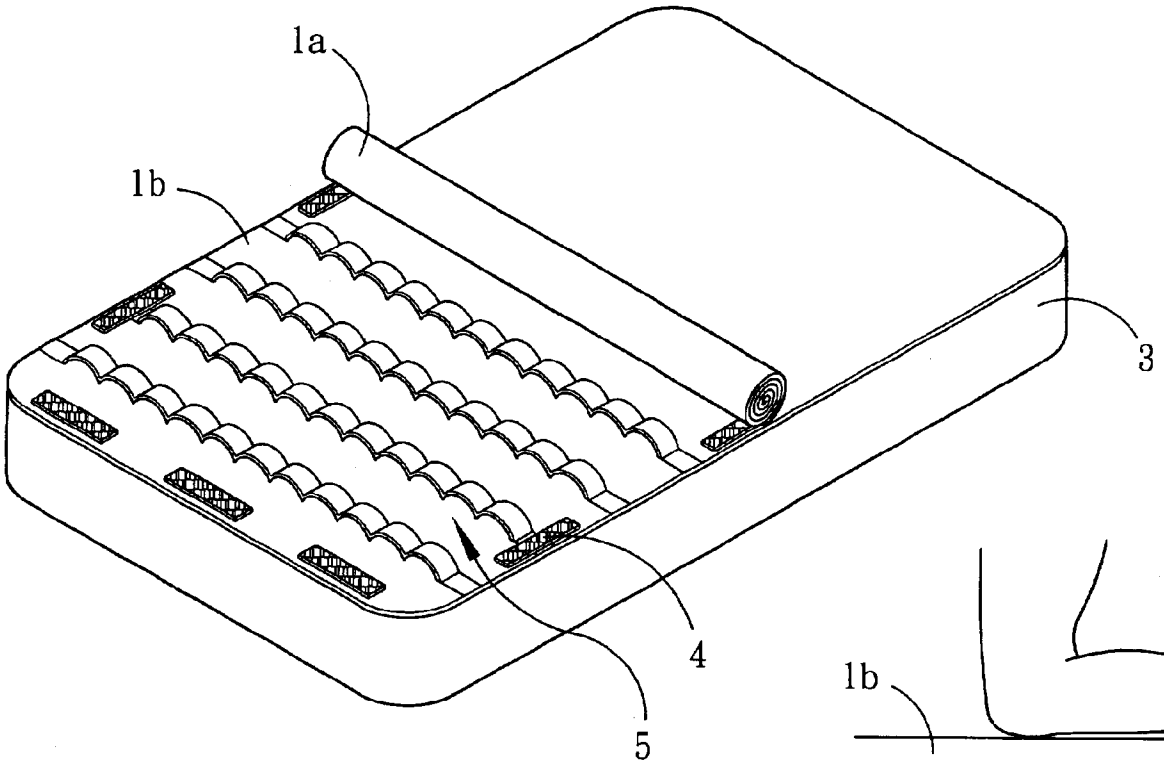
FIG. 7 shows the second embodiment spread on a spring bed.

Please refer to FIG. 6 and FIG. 7, wherein a second embodiment of this invention is shown. Two up and down rug bed cloth 1*a* and 1*b*, are combined together by adhesive bands 4 around the edges. The bottom rug bed cloth 1*b* has a plurality of parallel strips of material 5 are made of a cotton material or other soft material. Because the strips of material 5 are fixed on the top side of the down side rug bed cloth 1*b* by intermittent sewing, the part of the strips that are not sewn form rings 51 that can act as leg supports.

Figure 8:
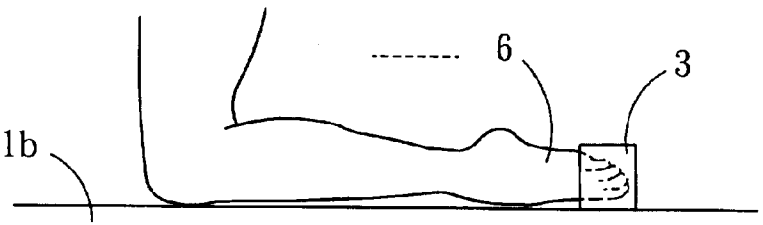
FIG. 8 shows the use of the second embodiment.

Using ring 51 as leg supports to fix a user's leg, the user's toes 6 then produce action points. When the user engages in sexual intercourse, the user's two legs, toes or fore part of the user's feet can act at respective rings 51 to increase the user's forward thrusting force (as shown in FIG. 8). The strips of materials 5 are sewn or fixed to a portion of rug bed cloth 1*b* adjacent one end thereof, in parallel, a V shape or other equivalent array to produce closed ring structures.

When not being used, the top and bottom rug bed cloths 1*a* and 1*b* are combined together for use as general rug bed cloth. When sexual intercourse is to be engaged in, the user can take off the top rug bed cloth 1*a* and roll it forward to predetermined position. The rolled rug bed cloth 1*a* can then be used as a head pillow or a hip pillow.

In this embodiment, the user can choose to use only the bottom rug bed cloth 1*b*. When not being used, it can be rolled into a small volume for travel or storage.

Summarized, this invention provide action and reaction points for a user's two legs, toes or fore part of the user's feet and is fixed by a pocket to receive an end of the spring bed therein or by tucking a portion of the rug bed cloth beneath the spring bed, and is assist by the weight of the user lying on the rug bed cloth. This invention will prevent slipping of the user's knees and provide action and reaction points for the user's two legs, toes or fore part of the user's feet. So, it will increase the quality of sexual intercourse of a couple and promote feelings between a wife and her husband.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A rug bed cloth structure for use by a pair of users to assist in holding a first user's legs in a fixed position, comprising:

a longitudinally extended lower rug bed cloth spread on an upper surface of a spring bed and having opposing first and second longitudinal ends;

a plurality of strips of material affixed to an upper surface of said lower rug bed cloth in spaced relationship adjacent said second end thereof, each of said strips of material extending in a direction transverse said longitudinal direction and being fastened to said lower rug bed cloth at transversely spaced locations to define ring portions therebetween for respectively receiving at least a portion of the first user's feet therein; and, a longitudinally extended upper rug bed cloth overlaying said upper surface of said lower rug bed cloth, said upper rug bed cloth being releasably coupled to said lower rug bed cloth along a perimeter portion thereof, said upper rug bed cloth being rolled longitudinally from said second end of the lower rug bed cloth toward said first end thereof to a selected position for forming a pillow to support a portion of a second user's body.

* * * * *